US007570774B2

(12) United States Patent
Jeong et al.

(10) Patent No.: US 7,570,774 B2
(45) Date of Patent: Aug. 4, 2009

(54) SPEAKER HAVING IMPROVED SOUND-RADIATING FUNCTION TO BOTH DIRECTIONS

(75) Inventors: In-Chan Jeong, Busan (KR); Sung-Il Cho, Busan (KR)

(73) Assignee: Estec Corporation (KR)

( * ) Notice: Subject to any disclaimer, the term of this patent is extended or adjusted under 35 U.S.C. 154(b) by 817 days.

(21) Appl. No.: 11/129,952

(22) Filed: May 16, 2005

(65) Prior Publication Data

US 2005/0271237 A1 Dec. 8, 2005

(30) Foreign Application Priority Data

May 25, 2004 (KR) ..... 10-2004-0037119
Apr. 25, 2005 (KR) ..... 10-2005-0033941

(51) Int. Cl.
*H04R 25/00* (2006.01)
*H04R 1/00* (2006.01)
*H04R 9/06* (2006.01)
*H04R 11/02* (2006.01)

(52) U.S. Cl. ..... 381/186; 381/420; 381/424; 381/433

(58) Field of Classification Search ..... 381/433, 381/398, 186
See application file for complete search history.

(56) References Cited

U.S. PATENT DOCUMENTS 4,281,224 A * 7/1981 Castagna ..... 381/391
4,727,586 A * 2/1988 Johnson ..... 381/186
5,157,731 A * 10/1992 Mitobe ..... 381/420
6,343,128 B1 * 1/2002 Coffin ..... 381/186
6,359,997 B2 * 3/2002 Geisenberger et al. ..... 381/412

* cited by examiner

*Primary Examiner*—Brian Ensey
*Assistant Examiner*—Matthew Eason
(74) *Attorney, Agent, or Firm*—Hedman & Costigan, P.C.

(57) ABSTRACT

A speaker having an improved sound-radiating function to both directions is provided. The speaker includes a magnetic circuit unit, a voice coil, and an auxiliary vibrating plate and a primary vibrating plate sequentially arranged from a forward direction. The voice coil vibrates toward a backward direction and a forward direction due to interaction with the magnetic circuit unit. The auxiliary vibrating plate is cone-shaped and has a damping function. The primary vibrating plate is also cone-shaped. Central necks of the primary vibrating plate and the auxiliary vibrating plate are fixed on the voice coil, respectively. The auxiliary vibrating plate is enlarged toward a forward direction and the primary vibrating plate is enlarged toward a backward direction.

9 Claims, 4 Drawing Sheets

PRIOR ART

SPEAKER HAVING IMPROVED SOUND-RADIATING FUNCTION TO BOTH DIRECTIONS

BACKGROUND ART

1. Field of the Invention

The present invention relates to a speaker having an improved sound-radiating function to both directions.

2. Description of the Related Art

A speaker is an audio apparatus for radiating sound waves, which are compression-rarefaction waves propagating through air used for a medium, by converting electrical sound signals into vibrations of a vibrating plate and compressing and expanding air using the vibrations of the vibrating plate.

A related art speaker will be described with reference to FIG. 1, which is a sectional view of a related art speaker.

As illustrated in FIG. 1, a speaker 10 includes a cone-shaped frame 20, a magnetic circuit unit 30 coupled to the frame 20, and a vibration unit 40.

The magnetic circuit unit 30 has a U-shaped yoke 31 whose upper portion is coupled to one side of the frame 20, and a magnet 33 and a pole piece 35 sequentially stacked and coupled in an inside of the yoke 31. At this point, a predetermined interval is interposed between an outer periphery of the magnet 33 and the pole piece 35 and an inner periphery of the yoke 31. The vibration unit 40 includes: a vibrating plate 41 having a coupling hole formed on a central portion of the vibrating plate 41 and whose outer periphery is coupled to the other side of the frame 20; and a voice coil 43 whose one end is coupled to the coupling hole and whose other end is disposed in the interval between the pole piece 35 and the yoke 31.

With such a construction, if an external voltage is applied to the voice coil 43, the voice coil 43 operates due to interaction between an electric field from the voice coil 43 and a magnetic field from the magnetic circuit unit 30 to vibrate the vibrating plate 41. Then, air contacting a surface of the vibrating plate 41 compresses and expands. due to the vibrations of the vibrating plate 41, so that a sound is produced. Unexplained reference numerals 51, 53, and 55 are a damper, a dust cap, and a gasket, respectively.

Since the related art speaker has the cone-shaped vibrating plate 41, much difference has occurred between a sound radiated to a forward direction where a diameter of the speaker is large and a sound radiated to a backward direction where a diameter of the speaker is small.

Also, since a sound radiated to the backward direction has been shielded due to the damper 51 and the magnetic circuit unit 30 installed at the rear side of the vibrating plate 41, such a difference in sounds has become severe.

SUMMARY OF THE INVENTION

An object of the present invention is to provide a speaker having an improved sound-radiating function to both directions capable of radiating a uniform sound to both directions by installing an auxiliary vibrating plate that functions as a damper.

According to an aspect of the present invention, there is provided a speaker of an improved sound-radiating function to both directions, having a magnetic circuit unit and a voice coil vibrating toward a backward direction and a forward direction due to interaction with the magnetic circuit unit, the speaker including: a cone-shaped auxiliary vibrating plate having a damping function and a cone-shaped primary vibrating plate sequentially installed from a forward direction, central necks of the auxiliary vibrating plate and the primary vibrating plate being fixed to a bobbin, respectively, the auxiliary vibrating plate being enlarged toward the forward direction, and the primary vibrating plate being enlarged toward a backward direction.

According to another aspect of the present invention, there is provided a speaker having an improved sound-radiating function to both direction, the speaker including: a gasket having a support formed by connecting a first ring-shaped member and a first end portion of a bridge extended forward in a central direction from the ring-shaped member; a frame having a support formed by connecting a second ring-shaped member and a second end portion of a bridge extended forward in a central direction from the ring-shaped member, the second ring-shaped member facing the first ring-shaped member and being connected with the gasket; a magnetic circuit unit fixed in the support of the gasket; a vibration unit installed in association with the magnetic circuit unit, for vibrating toward a backward direction and a forward direction due to interaction of the magnetic circuit unit; a primary vibrating plate having a fringe portion vibratably fixed between the ring-shaped members and a central neck fixed to the vibration unit; and an auxiliary vibrating plate having a fringe portion vibratably fixed to the second support of the frame and a central neck fixed to the vibration unit, the auxiliary vibrating plate having a damping function.

According to another aspect of the present invention, there is provided a speaker having an improved sound-radiating function to both directions, the speaker including: a gasket having a first support formed by connecting a first ring-shaped member and first end portions of bridges extended inward in a central direction from the first ring-shaped member; a frame having a second support formed by connecting a second ring-shaped member and second end portions of bridges extended outward in a central direction from the second ring-shaped member, the second ring-shaped member facing the first ring-shaped member and being connected with the gasket; a magnetic circuit unit fixed in the first support of the gasket; a bobbin installed in association with the magnetic circuit unit, and having a voice coil wired on an outer surface of the bobbin, the voice coil interacting with the magnetic circuit unit; a primary vibrating plate having a fringe portion vibratably fixed between the ring-shaped members and a central neck for receiving the bobbin, the central neck being fixed to the bobbin; and an auxiliary vibrating plate having a fringe portion vibratably fixed to the second support of the frame and a central neck for receiving the bobbin, the central neck being fixed to the bobbin, and the auxiliary vibrating plate having a damping function.

The primary vibrating plate may have a cone shape enlarged toward a backward direction and the auxiliary vibrating plate may have a cone shape enlarged toward a forward direction.

The central neck of the primary vibrating plate and the central neck of the auxiliary vibrating plate may be fixed on an outer surface of the bobbin at positions adjacent to each other.

The central neck of the primary vibrating plate and the central neck of the auxiliary vibrating plate may be bent and attached on an outer surface of the bobbin using an adhesive so that each of the central necks can be parallel with the outer surface of the bobbin.

Also, the central neck of the primary vibrating plate may be bent toward a forward direction and the central neck of the auxiliary vibrating plate may be bent toward a backward direction.

The magnetic circuit unit may include: a yoke having an outer wall fixed to the first support of the gasket and a through hole formed in a center of a backside of the yoke; a ring-shaped magnet attached on a surface in an inside of the yoke; and a pole piece attached on the magnet and having a through hole formed on a center thereof, and the through hole of the yoke, the center of the magnet, and the through hole of the pole piece are coupled so that they can be matched one another.

Alternatively, the magnetic circuit unit may include: a plate fixed to the first support of the gasket and having a through hole formed therein; a ring-shaped magnet attached on a backside of the plate; and a yoke having a flat portion attached on a backside of the magnet and having a protuberance passing through the magnet and the through hole of the plate and spaced a predetermined interval from the magnet and the plate, the protuberance being formed at a center portion of a bottom of the yoke.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

Now, preferred embodiments of the present invention will be described in detail with reference to the accompanying drawings.

Figure 1:
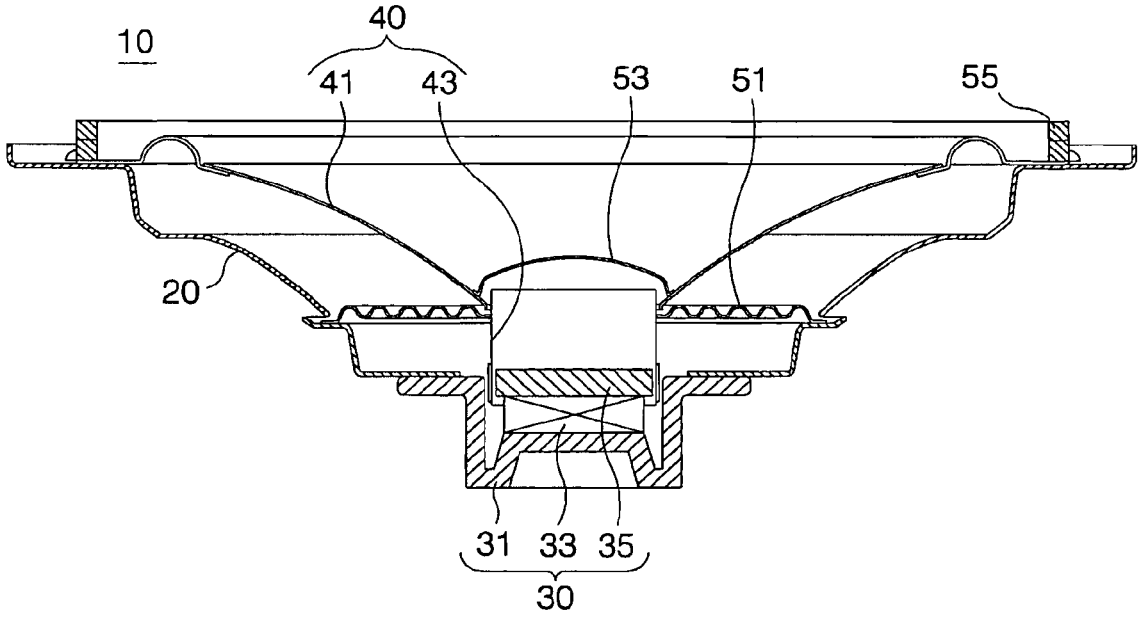
FIG. 1 is a sectional view of a related art speaker.
Figure 2:
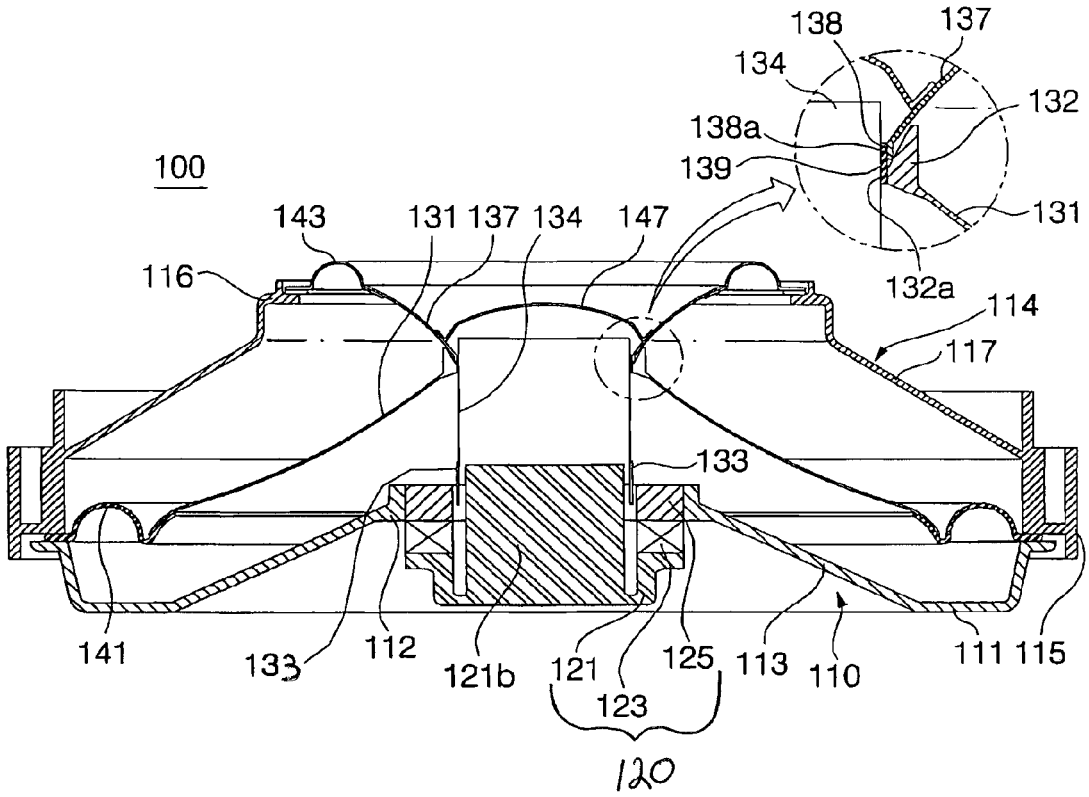
FIG. 2 is a sectional view of a speaker according to an embodiment of the present invention.
Figure 3:
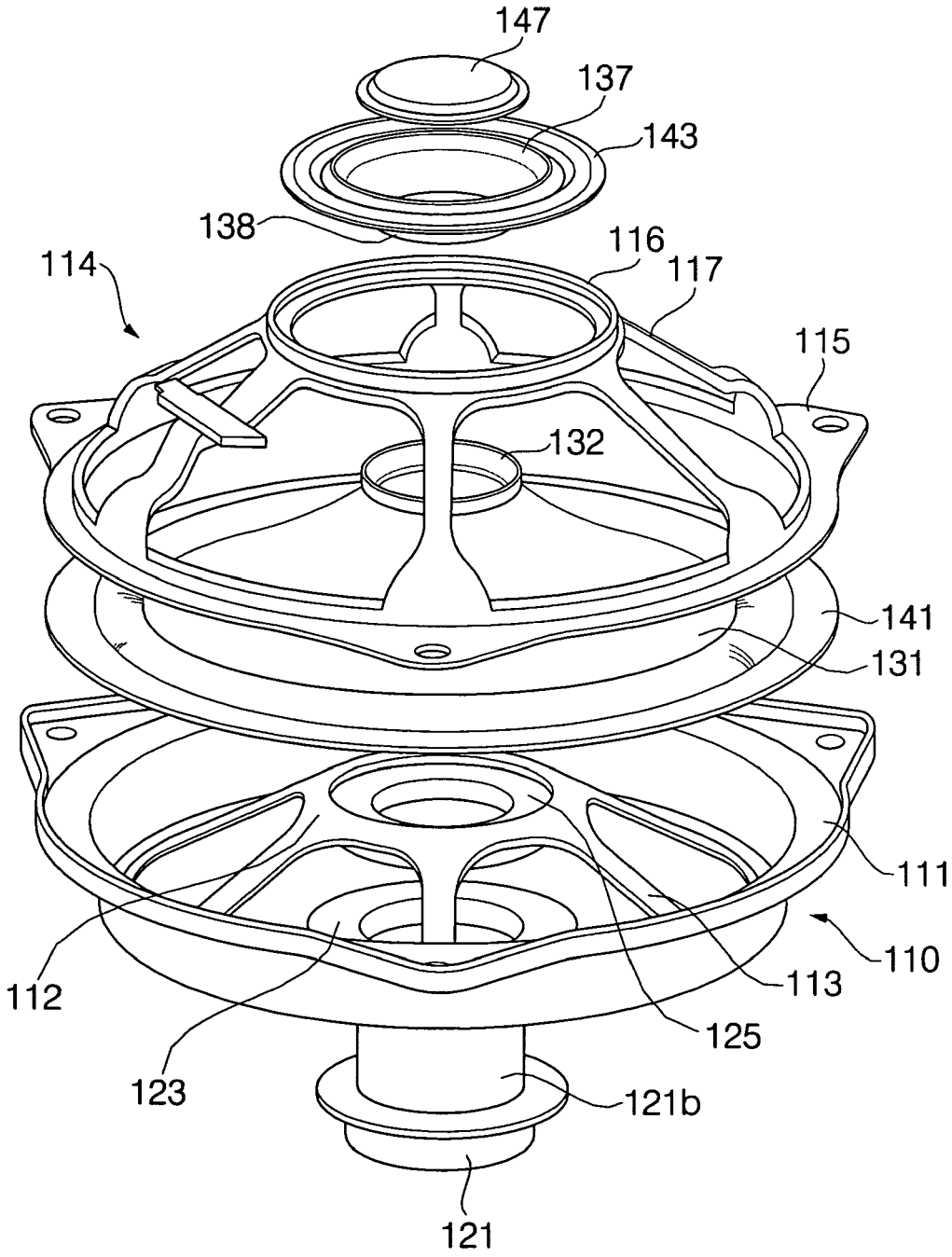
FIG. 3 is an exploded and perspective view of the speaker illustrated in FIG. 2.

FIG. 2 is a sectional view of a speaker according to an embodiment of the present invention and FIG. 3 is an exploded and perspective view of the speaker illustrated in FIG. 2.

In FIG. 2, an upper portion and a lower portion are a forward direction and a backward direction, respectively.

Referring to FIG. 2, a speaker 100 includes: a gasket 110 disposed in the backward direction; a magnetic circuit unit 120 fixed at a central portion of the gasket 110; a bobbin 134 on which a voice coil 133 is wired; a primary vibrating plate 131 and an auxiliary vibrating plate 137 having central necks respectively fixed at the bobbin 134; and a frame 114 for facing and being coupled to the gasket 110.

The gasket 110 includes a support 112 formed by connecting a ring-shaped member 111 and end portions of bridges 113 extended inward in a central direction (i.e., the backward direction) from the ring-shaped member 111. The gasket 110 can be formed in an integral type using a resin.

The frame 114 includes a support 116 formed by connecting another ring-shaped member 115 and end portions of bridges 117 extended inward in a central direction (i.e., the forward direction) from the ring-shaped member 115. The frame 114 can be formed in an integral type using a resin.

The ring-shaped member 115 of the frame 114 and the ring-shaped member 111 of the gasket 110 face and contact each other and can be coupled to each other using an appropriate member such as a screw.

Referring to FIG. 2, the magnetic circuit unit 120 includes: a plate 125 fit and fixed in the support 112 of the gasket 110 and having a through hole therein; a ring-shaped magnet 123 attached on a backside of the plate 125; and a yoke 121 having a flat portion attached on a backside of the magnet 123 and a protuberance 121*b* passing through the magnet 123 and the through hole of the plate 125, the protuberance 121*b* being formed at a central portion of the yoke 121. A predetermined interval is formed between the protuberance 121*b* and inner surfaces of the magnet 123 and the plate 125, so that a voice coil can be inserted therein as will be described below.

According to the present embodiment, the protuberance 121*b* of the yoke 121 is formed inside the yoke 121 so that a size of the magnetic circuit unit 120 can be reduced.

Figure 4:
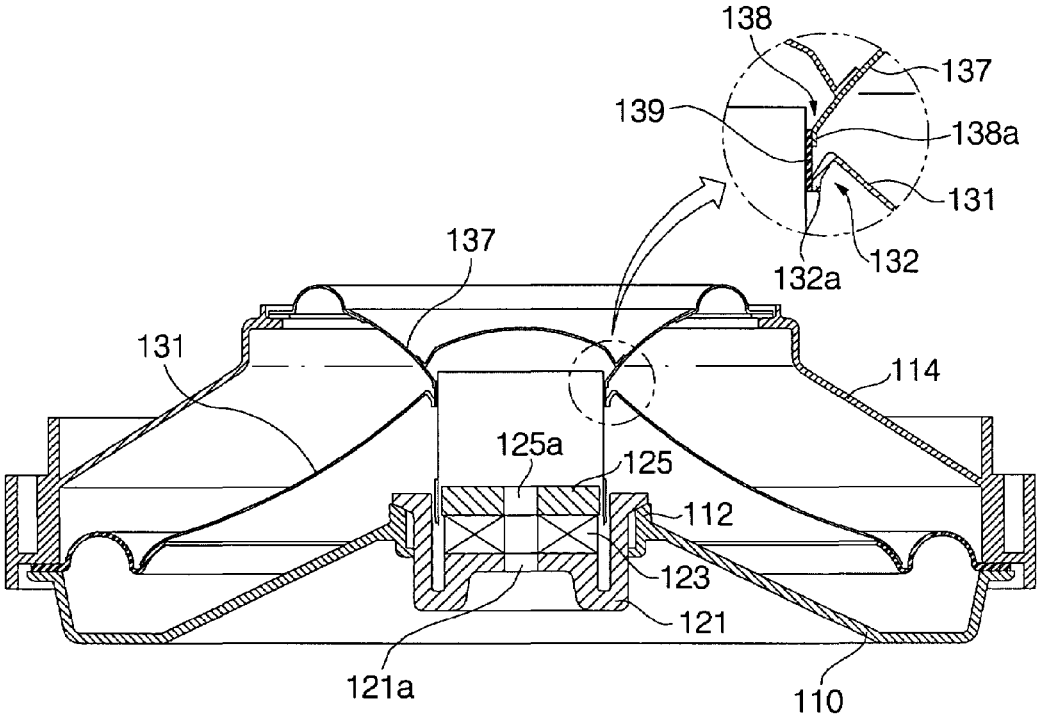
FIG. 4 is a sectional view of a speaker according to a modification of the present invention.

According to a modification of the present invention, referring to FIG. 4, a magnetic circuit unit 120 includes: a yoke 121 having an outer wall fixed to a support 112 of a gasket 110 and a through hole 121*a* formed in a center of a backside of the yoke 121; a ring-shaped magnet 123 attached on a surface in an inside of the yoke 121; and a plate 125 attached on the magnet 123 and having a through hole 125*a* formed at a center portion thereof. A predetermined interval is formed between an inner surface of the yoke 121 and outer surfaces of the magnet 123 and the plate 125, so that a voice coil can be inserted therein as will be described below.

According to the modification, since the respective through holes 121*a* and 125*a* and the through hole of the ring-shaped magnet 123 are coupled one another so that they may be matched with one another, heat from the voice coil can be easily emitted to the outside and a more lightweight magnetic circuit unit 120 can be manufactured.

A bobbin 134 has a barrel shape and has a voice coil 133 wired on a lower end thereof. A portion of the bobbin 134 on which the voice coil 133 is wired is inserted into the interval between the inner surface of the yoke 121 and the outer surfaces of the magnet 123 and the plate 125.

According to the present invention, the primary vibrating plate 131 has a cone shape. The fringe portion of the primary vibrating plate 131 is vibratably fixed to a portion where the ring-shaped member 111 of the gasket 110 and the ring-shaped member 115 of the frame 114 mutually face with an edge 141 of the primary vibrating plate 131 interposed. A central neck 132 of the primary vibrating plate 131 is fit on the bobbin 134 so that the primary vibrating plate 131 may be fixed on an upper portion of the bobbin 134. As described above, the fringe portion of the primary vibrating plate 131 is disposed to the lower portion (backward direction) and the central neck of the primary vibrating plate 131 is disposed to the upper portion (forward direction), so that the primary vibrating plate 131 has a shape extending toward the lower portion (the backward direction).

Also, the fringe portion of the auxiliary vibrating plate 137 is vibratably fixed to the support 116 of the frame 114 with an edge 143 of the auxiliary vibrating plate 137 interposed. A central neck 138 of the auxiliary vibrating plate 137 is fit on the bobbin 134 so that the auxiliary vibrating plate 137 may be fixed on the upper portion of the bobbin 134. The auxiliary vibrating plate 137 is fixed to a portion upper than the central neck 132 as much as possible. As described above, the fringe portion of the auxiliary vibrating plate 137 is disposed to the upper portion (forward direction) and the central neck of the auxiliary vibrating plate 137 is disposed to the lower portion (backward direction), so that the auxiliary vibrating plate 137 has a shape extending toward the upper portion (the forward direction).

Resultantly, the primary vibrating plate 131 has the shape extending toward the backward direction and the auxiliary vibrating plate 137 having a size smaller than the size of the primary vibrating plate 131 has the shape extending toward the forward direction.

According to the present invention, the auxiliary vibrating plate 137 has a damping function to support the bobbin 134.

Also, since the central necks 132 and 138 of the primary vibrating plate 131 and the auxiliary vibrating plate 137 are bent to form contact portions 132*a* and 138*a* parallel with an outer surface of the bobbin 134, contact areas can be widened so that the primary vibrating plate and the auxiliary vibrating plate 131 and 137 can be attached stably and easily. They can be attached using an adhesive 139.

At this point, the central neck 132 of the primary vibrating plate 131 can be bent clockwise as illustrated in FIG. 2 or counterclockwise as illustrated in FIG. 4. To reduce distortion of a sound, the central neck 132 may be bent clockwise as illustrated in FIG. 2.

An unexplained reference numeral 147 represents a dust cap for preventing foreign substance from flowing into the inside.

In operation, if external power is applied to the voice coil 133, the voice coil 133 vibrates up and down due to interaction between an electric field formed around the voice coil 133 and a magnetic field from the magnetic circuit unit 120.

If the voice coil 133 vibrates up and down, the primary vibrating plate 131 and the auxiliary vibrating plate 137 coupled to the voice coil 133 vibrate together. Then, air contacting the primary vibrating plate 131 and the auxiliary vibrating plate 137 compresses and expands due to the vibrations of the primary vibrating plate 131 and the auxiliary vibrating plate 137, which propagates a sound wave so that a sound is produced.

At this point, the auxiliary vibrating plate 137 has a damping function to prevent the voice coil 133 from vibrating in a horizontal direction.

A difference in sound quality is represented in a high-pitch region rather than a middle/low-pitch region in the forward/backward diction. According to the present invention, the cone-shaped primary vibrating plate 131 covering a middle/low-pitch region is installed in the form of extending toward the backward direction. To balance a sound propagating to the backward direction by the primary vibrating plate 131, the auxiliary vibrating plate 137 covering a middle/high-pitch region is installed in the form of extending toward the forward direction.

With such a construction, a sound propagates to the backward direction in a converging manner, and simultaneously, a sound propagates to the forward direction in an expanding manner without orientation due to the primary vibrating plate 131. Also, a sound propagates to the forward direction in a converging manner due to the auxiliary vibrating plate 137, so that a difference in sound quality in the forward/backward directions can be overcome.

Also, it is possible to maximize a sound propagating to the backward direction by removing a damper of the magnetic circuit unit 120 and reducing a size of the magnetic circuit unit 120.

As described above, the speaker having an improved sound-radiating function to both directions installs the primary vibrating plate of a large size to the side where a sound is shielded due to the magnetic circuit unit and installs the auxiliary vibrating plate of a size smaller than the size of the primary vibrating plate, to the side where there is no obstacle against a sound propagating. Also, since the magnetic circuit unit is configured so that a sound may pass through the central portion of the magnetic circuit unit, there is no quality difference in sounds radiated to one side and the other side of the frame.

While the present invention has been described in detail, it should be understood that various changes, substitutions and alterations can be made hereto without departing from the spirit and scope of the invention as defined by the appended claims.

What is claimed is:

1. A speaker having an improved sound-radiating function to both directions, having a magnetic circuit unit and a voice coil for vibrating toward a backward direction and a forward direction due to interaction with the magnetic circuit unit, the speaker comprising:

a cone-shaped auxiliary vibrating plate having a damping function and a cone-shaped primary vibrating plate sequentially installed onto a bobbin from the forward direction, central necks of the auxiliary vibrating plate and the primary vibrating plate being fixed to said bobbin, respectively, the auxiliary vibrating plate being enlarged toward the forward direction, and the primary vibrating plate being enlarged toward the backward direction, wherein said cone-shaped auxiliary vibrating plate is sized smaller than said cone-shaped primary vibrating plate, and wherein said primary vibrating plate radiates sound in a first direction and said auxiliary vibrating plate radiates sound in a second direction.

2. A speaker having an improved sound-radiating function to both directions, the speaker comprising:

a gasket having a first support formed by connecting a first ring-shaped member and a first end portion of a bridge extended forward in a central direction from the first ring-shaped member;

a frame having a second support formed by connecting a second ring-shaped member and a second end portion of a bridge extended forward in a central direction from the second ring-shaped member, the second ring-shaped member facing the first ring-shaped member and being connected with the gasket;

a magnetic circuit unit fixed in the first support of the gasket;

a vibration unit installed in association with the magnetic circuit unit, for vibrating toward a backward direction and a forward direction due to interaction of the magnetic circuit unit;

a primary vibrating plate having a fringe portion vibratably fixed between the ring-shaped members and a central neck fixed to the vibration unit; and an auxiliary vibrating plate having a fringe portion vibratably fixed to the second support of the frame and a central neck fixed to the vibration unit, the auxiliary vibrating plate having a damping function, wherein the auxiliary vibrating plate is sized smaller than the primary vibrating plate, and wherein said primary vibrating plate radiates sound in a first direction and said auxiliary vibrating plate radiates sound in a second direction.

3. The speaker of claim 2, wherein the primary vibrating plate has a cone shape enlarged toward a backward direction and the auxiliary vibrating plate has a cone shape enlarged toward a forward direction.

4. The speaker of claim 2, wherein the central neck of the primary vibrating plate and the central neck of the auxiliary vibrating plate are fixed to the vibration unit at adjacent positions.

5. The speaker of claim 4, wherein the central neck of the primary vibrating plate and the central neck of the auxiliary vibrating plate are bent and attached on an outer surface of a bobbin using an adhesive so that each of the central necks is parallel with the vibration unit.

6. The speaker of claim 5, wherein the central neck of the primary vibrating plate is bent toward the forward direction and the central neck of the auxiliary vibrating plate is bent toward the backward direction.

7. The speaker of claim 2, wherein the magnetic circuit unit comprises:

a yoke having an outer wall fixed to the first support of the gasket and a through hole formed in a center of a backside of the yoke;

a ring-shaped magnet attached on a surface in an inside of the yoke; and a pole piece attached on the magnet and having a through hole formed on a center thereof, the through hole of the yoke, a center of the magnet, and the through hole of the pole piece being coupled so that they are matched one another.

8. The speaker of claim 2, wherein the magnetic circuit unit comprises:

a plate fixed to the first support of the gasket and having a through hole formed therein;

a ring-shaped magnet attached on a backside of the plate; and a yoke having a flat portion attached on a backside of the magnet and a protuberance passing through the magnet and the through hole of the plate and spaced a predetermined interval from the magnet and the plate, the protuberance being formed on a central portion of a bottom of the yoke.

9. A speaker having an improved sound-radiating function to both directions, the speaker comprising:

a gasket having a first support formed by connecting a first ring-shaped member and first end portions of bridges extended inward in a central direction from the first ring-shaped member;

a frame having a second support formed by connecting a second ring-shaped member and second end portions of bridges extended outward in a central direction from the second ring-shaped member, the second ring-shaped member facing the first ring-shaped member and being connected with the gasket;

a magnetic circuit unit fixed in the first support of the gasket;

a bobbin installed in association with the magnetic circuit unit, and having a voice coil wired on an outer surface of the bobbin, the voice coil interacting with the magnetic circuit unit;

a primary vibrating plate having a fringe portion vibratably fixed between the ring-shaped members and a central neck for receiving the bobbin, the central neck being fixed to the bobbin; and an auxiliary vibrating plate having a fringe portion vibratably fixed to the second support of the frame and a central neck for receiving the bobbin, the central neck being fixed to the bobbin, and the auxiliary vibrating plate having a damping function, wherein the auxiliary vibrating plate is sized smaller than the primary vibrating plate, and wherein said primary vibrating plate radiates sound in a first direction and said auxiliary vibrating plate radiates sound in a second direction.

* * * * *